US008459340B2

(12) United States Patent
Liu et al.

(10) Patent No.: US 8,459,340 B2
(45) Date of Patent: Jun. 11, 2013

(54) FLAT HEAT PIPE WITH VAPOR CHANNEL

(75) Inventors: Yue Liu, KunShan (CN); Sheng-Liang Dai, KunShan (CN); Jin-Peng Liu, KunShan (CN); Sheng-Guo Zhou, KunShan (CN); Sheng-Lin Wu, Tu-Cheng (TW); Yu-Liang Lo, Tu-Cheng (TW)

(73) Assignees: Furui Precise Component (Kunshan) Co., Ltd., Kunshan (CN); Foxconn Technology Co., Ltd., New Taipei (TW)

( * ) Notice: Subject to any disclaimer, the term of this patent is extended or adjusted under 35 U.S.C. 154(b) by 382 days.

(21) Appl. No.: 12/817,206

(22) Filed: Jun. 17, 2010

(65) Prior Publication Data

US 2011/0174465 A1 Jul. 21, 2011

(30) Foreign Application Priority Data

Jan. 15, 2010 (CN) ..... 2010 1 0300330

(51) Int. Cl.
*F28D 15/00* (2006.01)
*H05K 7/20* (2006.01)

(52) U.S. Cl.
USPC ..... 165/104.26; 361/700

(58) Field of Classification Search
USPC . 165/146, 169, 104.26, 104.33, 170; 361/700
See application file for complete search history.

(56) References Cited

U.S. PATENT DOCUMENTS

| | | | | |
|---|---|---|---|---|
| 3,901,311 | A * | 8/1975 | Kosson et al. | 165/104.26 |
| 2001/0047859 | A1* | 12/2001 | Ishida et al. | 165/104.14 |
| 2007/0006993 | A1* | 1/2007 | Meng et al. | 165/104.26 |
| 2007/0228116 | A1* | 10/2007 | Hsu | 228/244 |
| 2008/0210407 | A1* | 9/2008 | Kim et al. | 165/104.26 |
| 2009/0020269 | A1* | 1/2009 | Chang et al. | 165/104.26 |
| 2009/0084526 | A1* | 4/2009 | Chang et al. | 165/104.26 |
| 2009/0139696 | A1* | 6/2009 | Shih et al. | 165/104.26 |
| 2011/0024085 | A1* | 2/2011 | Huang et al. | 165/104.26 |
| 2011/0214841 | A1* | 9/2011 | Huang et al. | 165/104.26 |

FOREIGN PATENT DOCUMENTS

| | | | |
|---|---|---|---|
| CN | 1955628 | A | 5/2007 |
| CN | 101398272 | A | 4/2009 |

* cited by examiner

*Primary Examiner* — Allen Flanigan
*Assistant Examiner* — Jason Thompson
(74) *Attorney, Agent, or Firm* — Altis Law Group, Inc.

(57) ABSTRACT

An exemplary flat heat pipe with an evaporator section and a condenser section includes a hollow casing, and a first wick structure and a second wick structure in the casing. The second structure contacts an inner surface of the casing at the evaporator section. The first structure at the evaporator section includes a first contact portion contacting an inner surface of the second structure, and a first isolated portion from the inner surface of the second structure. The first isolated portion and the inner surface of the second structure define a first channel therebetween. The first structure at the condenser section includes a second contact portion contacting the inner surface of the casing, and a second isolated portion from the inner surface of the casing. The second isolated portion and the inner surface of the casing define therebetween a second channel communicating with the first channel.

20 Claims, 9 Drawing Sheets

FLAT HEAT PIPE WITH VAPOR CHANNEL

CROSS-REFERENCE TO RELATED APPLICATIONS

This application is related to two co-pending applications respectively entitled "FLAT HEAT PIPE AND METHOD FOR MANUFACTURING THE SAME" Ser. No. 12/817,203 and "FLAT HEAT PIPE" Ser. No. 12/817,210, assigned to the same assignee of this application and filed on the same date as this application. The two related applications are incorporated herein by reference.

BACKGROUND

1. Technical Field

The disclosure generally relates to heat transfer apparatuses, and particularly to a heat pipe with high heat transfer efficiency.

2. Description of Related Art

Heat pipes are widely used in various fields for heat dissipation purposes due to their excellent heat transfer performance. One commonly used heat pipe includes a sealed tube made of heat conductive material, with a working fluid contained therein. The working fluid conveys heat from one end of the tube, typically referred to as an evaporator section, to the other end of the tube, typically referred to as a condenser section. Preferably, a wick structure is provided inside the heat pipe, lining an inner wall of the tube, and drawing the working fluid back to the evaporator section after it condenses at the condenser section.

During operation, the evaporator section of the heat pipe maintains thermal contact with a heat-generating electronic component. The working fluid at the evaporator section absorbs heat generated by the electronic component, and thereby turns to vapor. Due to the difference in vapor pressure between the two sections of the heat pipe, the generated vapor moves, carrying the heat with it, toward the condenser section. At the condenser section, the vapor condenses after transferring the heat to, for example, fins thermally contacting the condenser section. The fins then release the heat into the ambient environment. Due to the difference in capillary pressure which develops in the wick structure between the two sections, the condensate is then drawn back by the wick structure to the evaporator section where it is again available for evaporation.

In ordinary use, the heat pipe is flattened to increase a contact area with the electronic component and enable smaller electronic products to incorporate the heat pipe. However, this may downsize a vapor channel of the heat pipe through which the vapor flows from the evaporator section to the condenser section. In such case, the generated vapor may not move toward the condenser section in a timely manner, and the heat transfer efficiency of the heat pipe is thereby reduced.

What is needed, therefore, is a flat heat pipe with a vapor channel which can overcome the described limitations.

BRIEF DESCRIPTION OF THE DRAWINGS

Many aspects of the present embodiments can be better understood with reference to the following drawings. The components in the drawings are not necessarily drawn to scale, the emphasis instead placed upon clearly illustrating the principles of the present embodiments. Moreover, in the drawings, like reference numerals designate corresponding parts throughout the various views, and all the views are schematic.

DETAILED DESCRIPTION

Figure 1:
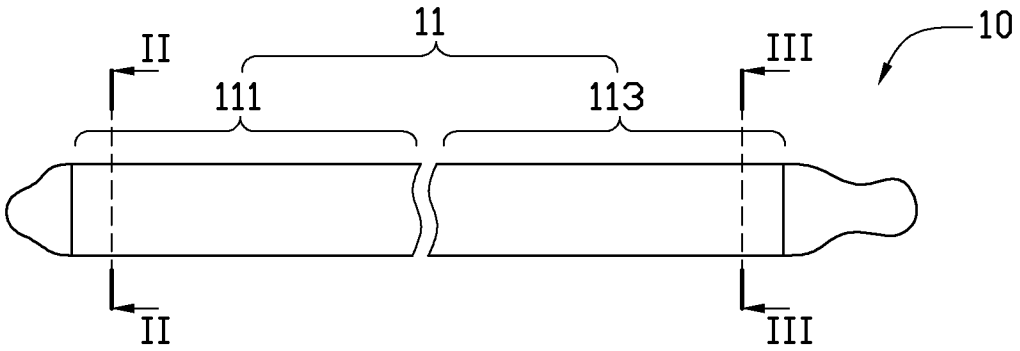
FIG. 1 is an abbreviated, lateral side plan view of a heat pipe in accordance with a first embodiment of the disclosure.
Figure 2:
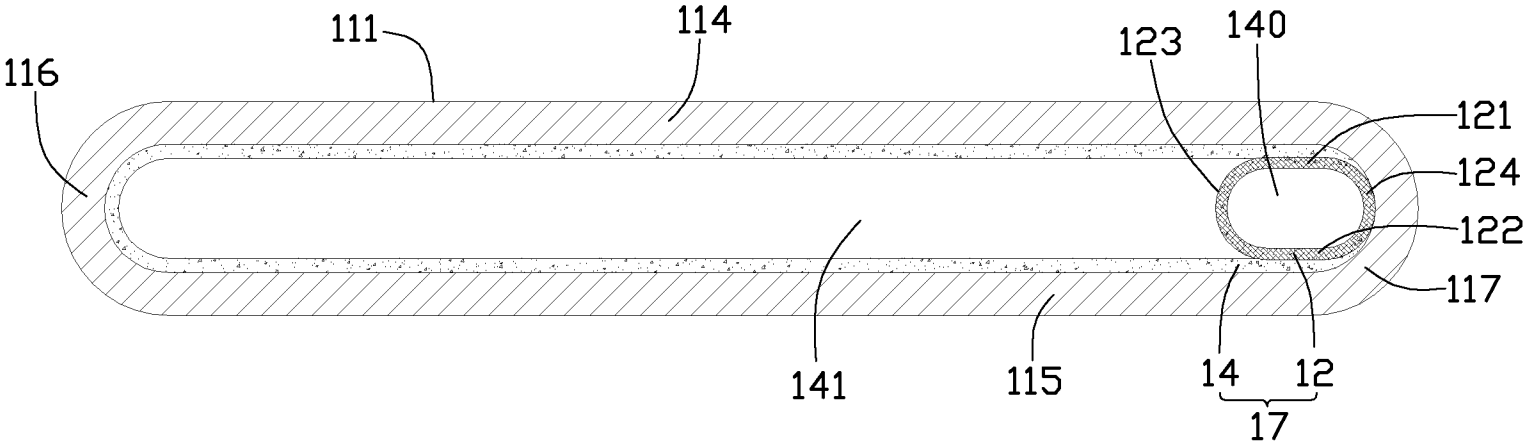
FIG. 2 is an enlarged, transverse cross section of the heat pipe of FIG. 1, taken along line II-II thereof.
Figure 3:
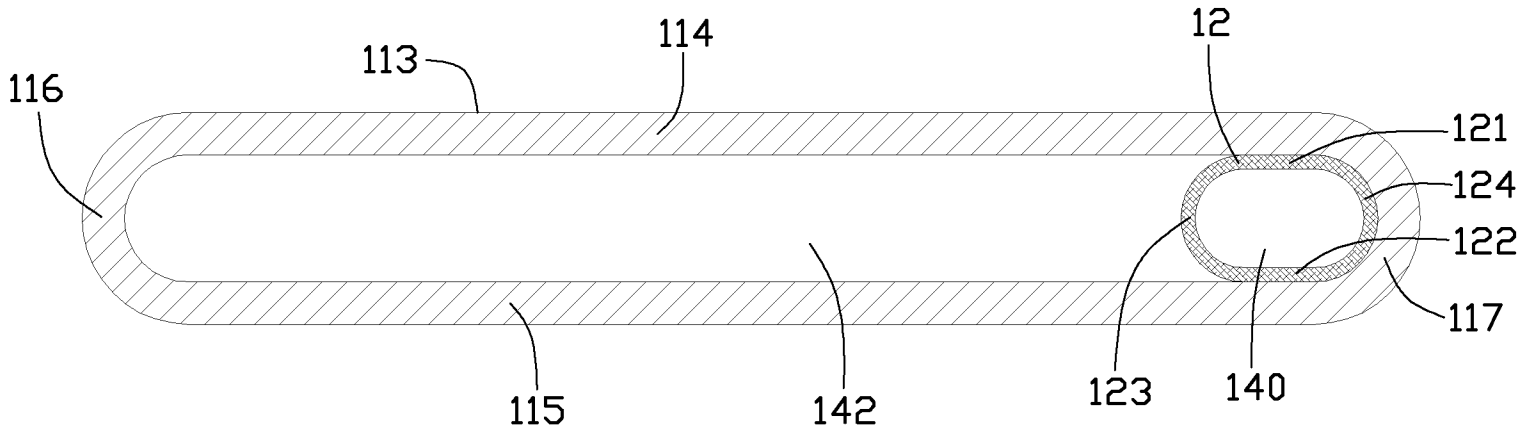
FIG. 3 is an enlarged, transverse cross section of the heat pipe of FIG. 1, taken along line thereof.

Referring to FIGS. 1-3, a heat pipe 10 in accordance with a first embodiment of the disclosure is shown. The heat pipe 10 is a flat heat pipe, and includes a flat tube-like casing 11 with two ends thereof sealed, and a variety of elements enclosed in the casing 11. Such elements include a first wick structure 12, a second wick structure 14, and a working medium (not shown).

The casing 11 is made of metal or metal alloy with a high heat conductivity coefficient, such as copper, copper-alloy, or other suitable material. The casing 11 is elongated, and has an evaporator section 111 and an opposite condenser section 113 located end-to-end along a longitudinal direction thereof. The casing 11 has a width larger than its height. In particular, the casing 11 has a flattened transverse cross section. To meet the height requirements of common electronic products, the height of the casing 11 is preferably less than 2 millimeters (mm) The casing 11 is hollow, and includes a top plate 114, a bottom plate 115 opposite to the top plate 114, and two side plates 116, 117 interconnecting the top and bottom plates 114, 115. The top and bottom plates 114, 115 are flat and parallel to each other. The side plates 116, 117 are arcuate and respectively disposed at opposite lateral sides of the casing 11.

The second wick structure 14 is only located in the evaporator section 111 of the heat pipe 10, and snugly contacts most of the casing 11 thereat, including the entire flat top and bottom inner surfaces of the top and bottom plates 114, 115 and the curved inner surface of the side plate 116 within the evaporator section 111. The second wick structure 14 is hollow, and made of sintered metal powder, such as copper powder or other suitable material.

The first wick structure 12 is an elongated hollow tube, and extends longitudinally through both the evaporator section 111 and the condenser section 113. An inner space 140 is longitudinally defined in the first wick structure 12. The first wick structure 12 is a monolayer-type structure formed by weaving a plurality of metal wires such as copper or stainless steel wires. The first wick structure 12 thus has a plurality of pores therein. Alternatively, the first wick structure 12 can be a multilayer-type structure layered along a radial direction thereof by weaving a plurality of metal wires. The first and second wick structures 12, 14 cooperatively define a first vapor channel 141 therebetween at the evaporator section 111. The first wick structure 12 and the inner surface of the casing 11 cooperatively define a second vapor channel 142 therebetween at the condenser section 113. An end of the first vapor channel 141 communicates with an end of the second vapor channel 142. The first and second vapor channels 141, 142 provide a passage through which the vapor flows from the evaporator section 111 to the condenser section 113.

The first wick structure 12 is extruded to a flattened shape by the inner surface of the casing 11. The first wick structure 12 has a flattened transverse cross section, similar in principle to the flattened transverse cross section of the casing 11. In particular, the first wick structure 12 includes a top wall 121, a bottom wall 122 opposite to the top wall 121, and a left sidewall 123 and a right sidewall 124 interconnecting the top and bottom walls 121, 122. The top and bottom walls 121, 122 are flat and parallel to each other. The left and right sidewalls 123, 124 are arcuate and respectively disposed at opposite lateral sides of the first wick structure 12.

In this embodiment, the first wick structure 12 is disposed at a right inner side of the casing 11. At the evaporator section 111 of the heat pipe 10, the first wick structure 12 is located in and semi-enclosed by the second wick structure 14. The top wall 121 and a top portion of the right sidewall 124 of the first wick structure 12 adjoining the top wall 121 cooperatively form a first contact portion in contact with an inner surface of an upper wall of the second wick structure 14. The bottom wall 122 and a bottom portion of the right sidewall 124 of the first wick structure 12 adjoining the bottom wall 122 cooperatively form another first contact portion in contact with an inner surface of a lower wall of the second wick structure 14. The first wick structure 12 is joined to the second wick structure 14 by sintering. The first and second wick structures 12, 14 cooperatively form a composite wick structure 17 in the evaporator section 111 of the casing 11. A center portion of the right sidewall 124 of the first wick structure 12 forms a connecting portion in contact with the curved inner surface of the side plate 117 of the casing 11. The left sidewall 123 of the first wick structure 12 forms a C-shaped first isolated portion isolated from the inner surface of the second wick structure 14. The first vapor channel 141 is cooperatively defined by the left sidewall 123 of the first wick structure 12 and the inner surface of the second wick structure 14.

At the condenser section 113 of the heat pipe 10, the top wall 121, the bottom wall 122 and the right sidewall 124 of the first wick structure 12 cooperatively form a U-shaped second contact portion, which is in contact with part of the inner surface of the top plate 114, part of the inner surface of the bottom plate 115 and the inner surface of the side plate 117. The left sidewall 123 of the first wick structure 12 forms a C-shaped second isolated portion isolated from the inner surface of the casing 11. The second vapor channel 142 is cooperatively defined by the left sidewall 123 of the first wick structure 12 and the inner surface of the casing 11.

The working medium is saturated in the first and second wick structures 12, 14. The working medium is usually selected from a liquid such as water, methanol, or alcohol, which has a low boiling point. The casing 11 of the heat pipe 10 is evacuated and hermetically sealed after the working medium is injected into the casing 11 and saturated in the first and second wick structures 12, 14. Thus, the working medium can easily evaporate when it receives heat at the evaporator section 111 of the heat pipe 10.

In operation, the evaporator section 111 of the heat pipe 10 is placed in thermal contact with a heat source (not shown) that needs to be cooled. The heat source can, for example, be a central processing unit (CPU) of a computer. The working medium contained in the evaporator section 111 of the heat pipe 10 is vaporized when receiving heat generated by the heat source. The generated vapor moves from the evaporator section 111 via the vapor channels 141, 142 to the condenser section 113. After the vapor releases its heat and condenses in the condenser section 113, the condensate is returned by the first and second wick structures 12, 14 to the evaporator section 111 of the heat pipe 10, where the condensate is again available for evaporation.

In the heat pipe 10, the second wick structure 14 is only located in the evaporator section 111, and the first wick structure 12 extends from the evaporator section 111 into the condenser section 113. The first and second wick structures 12, 14 cooperatively form the composite wick structure 17 at the evaporator section 111 of the heat pipe 10. This increases capillary force, and reduces flow resistance and heat resistance. As a result, the condensate is returned to the evaporator section 111 of the heat pipe 10 rapidly, thus preventing potential drying out at the evaporator section 111. In addition, the second wick structure 14 is not disposed at the condenser section 113 of the heat pipe 10. This enlarges the second vapor channel 142 in the condenser section 113, and further promotes the flow of the working medium in the heat pipe 10. Furthermore, the first wick structure 12 is joined to the second wick structure 14 by sintering. Thus, the first wick structure 12 snugly contacts the second wick structure 14, and the working medium can be rapidly saturated in the second wick structure 14 after returning to the evaporator section 111 via the first wick structure 12. Moreover, the first wick structure 12 cannot move freely in the casing 11. This increases the flow of the working medium in the casing 11, and improves the heat transfer performance of the heat pipe 10.

In alternative embodiments, the number of first wick structures 12 and/or the location(s) of the first wick structure(s) 12 in the heat pipe 10 can be varied. The following embodiments include examples of such variations.

Figure 4:
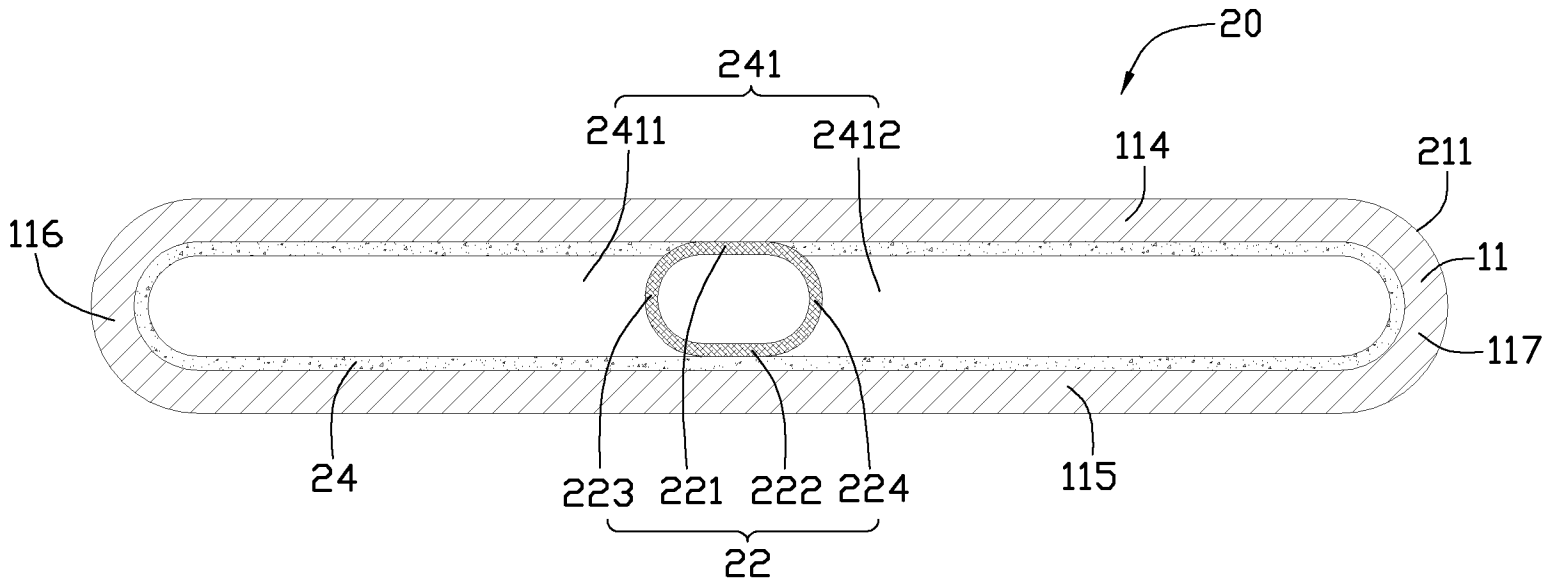
FIG. 4 is similar to FIG. 2, but shows a transverse cross section of a heat pipe according to a second embodiment of the disclosure.
Figure 5:
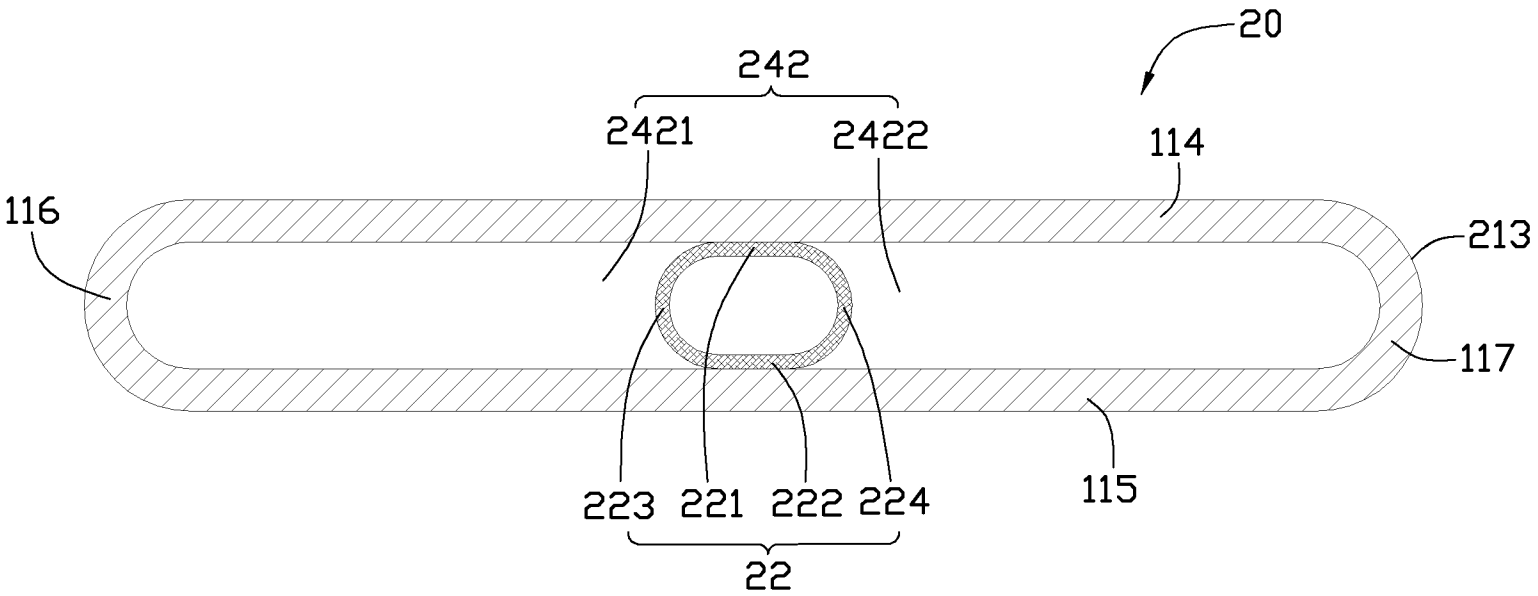
FIG. 5 is similar to FIG. 3, but shows a transverse cross section of the heat pipe according to the second embodiment of the disclosure.

Referring to FIGS. 4 and 5, a heat pipe 20 in accordance with a second embodiment of the disclosure is shown. The heat pipe 20 differs from the heat pipe 10 of the first embodiment only in that a first wick structure 22 is disposed at a center of the casing 11.

At an evaporator section 211 of the heat pipe 20, a top wall 221 of the first wick structure 22 forms a connecting portion in contact with the inner surface of the top plate 114 of the casing 11. A bottom wall 222 of the first wick structure 22 forms a first contact portion in contact with an inner surface of a second wick structure 24. Sidewalls 223, 224 of the first wick structure 22 form two first isolated portions isolated from the inner surface of the second wick structure 24. Two first passages 2411, 2412 are respectively defined between the sidewalls 223, 224 of the first wick structure 22 and the inner surface of the second wick structure 24, the first passages 2411, 2412 being disposed at opposite sides of the first wick structure 22, respectively. The two first passages 2411, 2412 cooperatively form a first vapor channel 241.

At a condenser section 213 of the heat pipe 20, the top and bottom walls 221, 222 of the first wick structure 22 cooperatively form two second contact portions in contact with the top and bottom plates 114, 115 of the inner surface of the casing 11, respectively. The sidewalls 223, 224 of the first wick structure 22 cooperatively form a second isolated portion isolated from the inner surface of the casing 11. Two second passages 2421, 2422 are respectively defined between the sidewalls 223, 224 of the first wick structure 22 and the inner surface of the casing 11, the second passages 2421, 2422 being disposed at opposite sides of the first wick structure 22, respectively. The two second passages 2421, 2422 cooperatively form a second vapor channel 242. Ends of the second passages 2421, 2422 communicate with ends of the first passages 2411, 2412, respectively.

Figure 6:
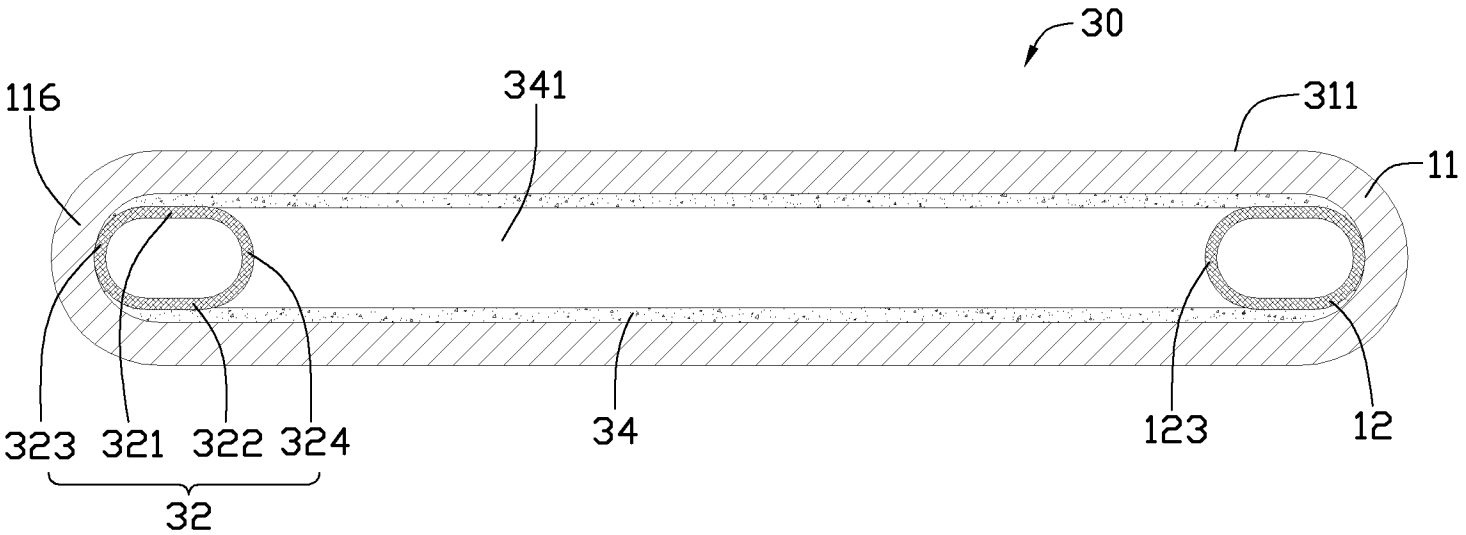
FIG. 6 is similar to FIG. 2, but shows a transverse cross section of a heat pipe according to a third embodiment of the disclosure.
Figure 7:
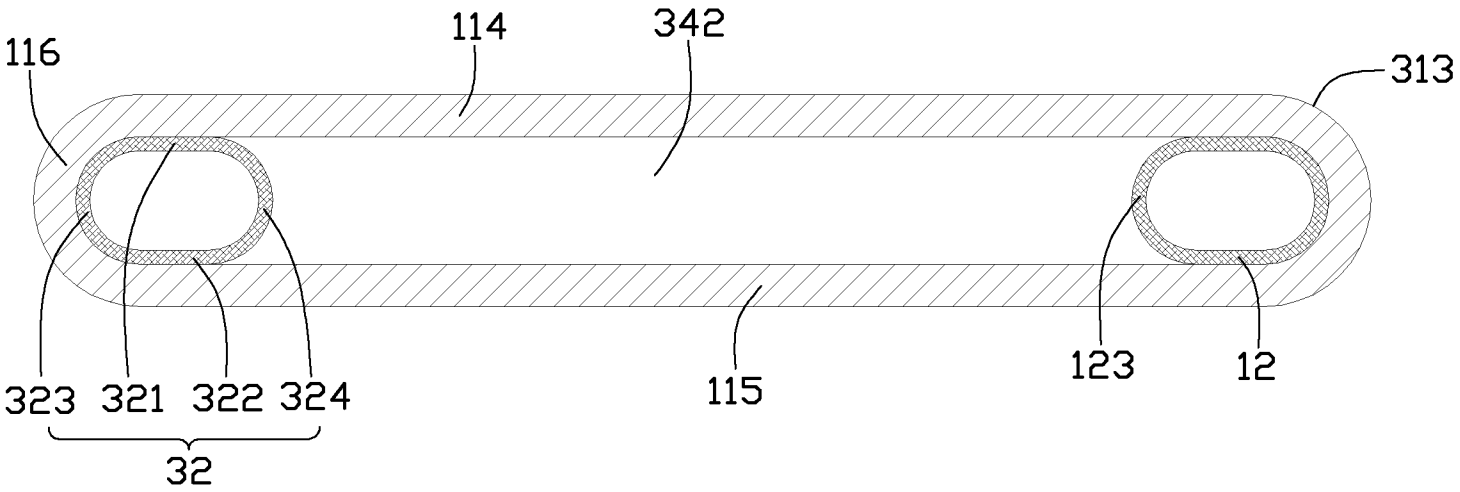
FIG. 7 is similar to FIG. 3, but shows a transverse cross section of the heat pipe according to the third embodiment of the disclosure.

Referring to FIGS. 6 and 7, a heat pipe 30 in accordance with a third embodiment of the disclosure is shown. The heat pipe 30 differs from the heat pipe 10 of the first embodiment only in that another first wick structure 32 is deployed in the casing 11, for a total of two first wick structures 12, 32. The first wick structures 12, 32 are located at opposite inner lateral sides of the casing 11. The first wick structures 12, 32 are spaced from each other, and are symmetrically arranged in the casing 11. A right sidewall 324 of the first wick structure 32 faces the left sidewall 123 of the first wick structure 12.

At an evaporator section 311 of the heat pipe 30, a top wall 321 and a top portion of a left sidewall 323 of the first wick structure 32 adjoining the top wall 321 cooperatively form a first contact portion in contact with the inner surface of the second wick structure 34. A bottom wall 322 and a bottom portion of the left sidewall 323 of the first wick structure 32 adjoining the bottom wall 322 cooperatively form another first contact portion in contact with the inner surface of the second wick structure 34. A center portion of the left sidewall 323 of the first wick structure 32 forms a connecting portion in contact with the inner surface of the side plate 116 of the casing 11. A right sidewall 324 of the first wick structure 32 forms a first isolated portion isolated from the inner surface of the second wick structure 34. The right sidewall 324 of the first wick structure 32, the left sidewall 123 of the first wick structure 12, and the inner surface of the second wick structure 34 cooperatively define a first vapor channel 341 therebetween.

At a condenser section 313 of the heat pipe 30, the top wall 321, the bottom wall 322 and the left sidewall 323 of the first wick structure 32 cooperatively form a U-shaped second contact portion, which is in contact with part of the inner surface of the top plate 114, part of the inner surface of the bottom plate 115, and the inner surface of the side plate 116. The right sidewall 324 of the first wick structure 32 forms a C-shaped second isolated portion isolated from the inner surface of the casing 11. The right sidewall 324 of the first wick structure 32, the left sidewall 123 of the first wick structure 12, and the inner surface of the casing 11 cooperatively define a second vapor channel 342 therebetween. An end of the second vapor channel 342 communicates with an end of the first vapor channel 341.

Figure 8:
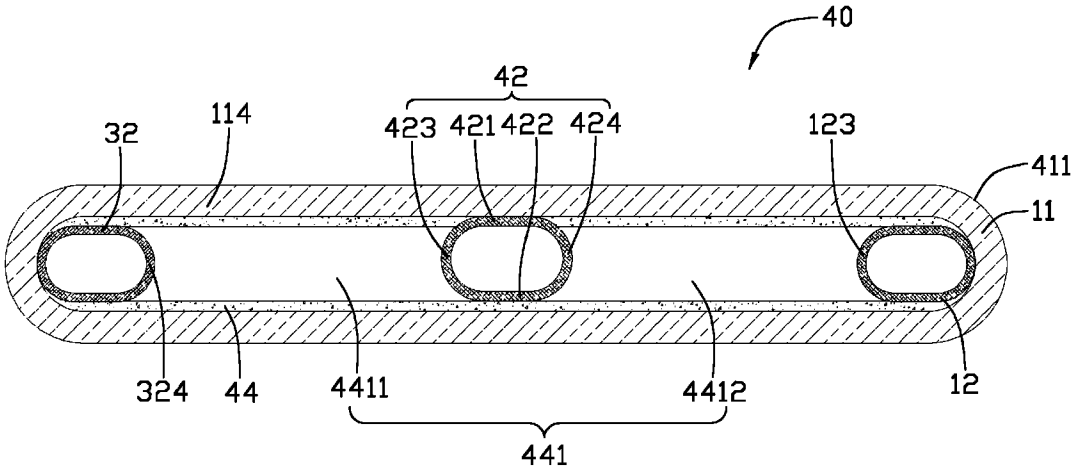
FIG. 8 is similar to FIG. 2, but shows a transverse cross section of a heat pipe according to a fourth embodiment of the disclosure.
Figure 9:
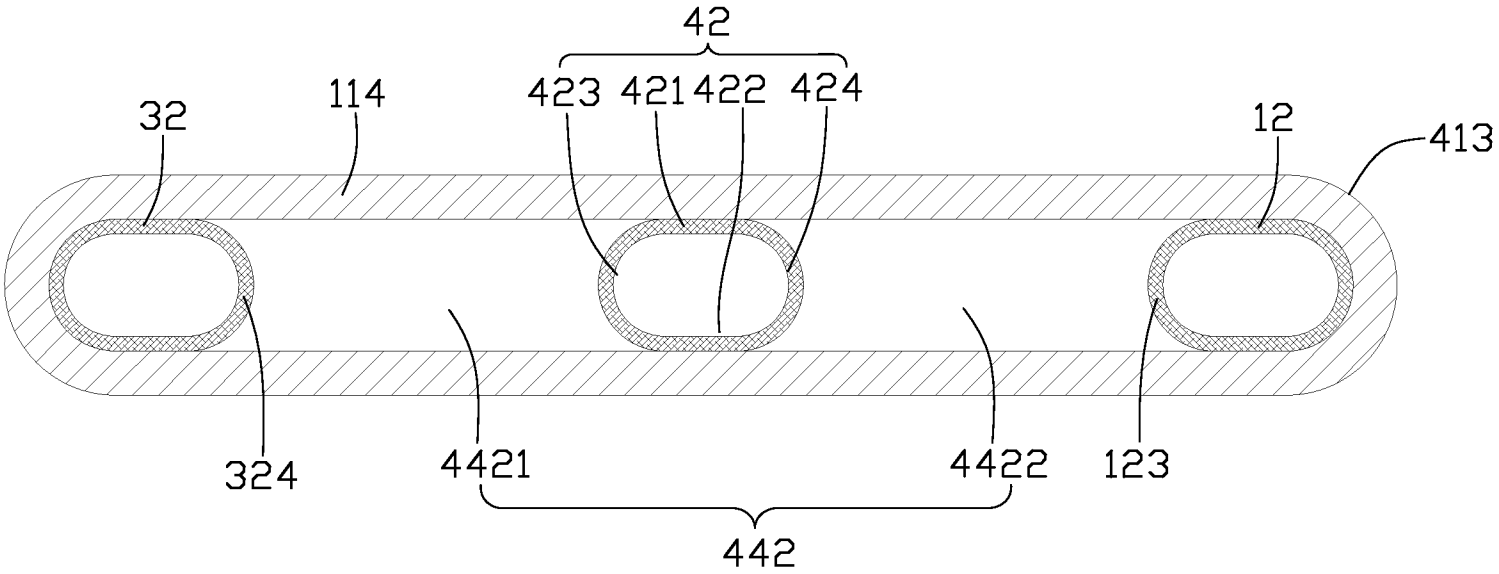
FIG. 9 is similar to FIG. 3, but shows a transverse cross section of the heat pipe according to the fourth embodiment of the disclosure.

Referring to FIGS. 8 and 9, a heat pipe 40 in accordance with a fourth embodiment of the disclosure is shown. The heat pipe 40 differs from the heat pipe 30 of the third embodiment only in that another first wick structure 42 is deployed in the casing 11, for a total of three first wick structures 12, 32, 42. The first wick structures 12, 32, 42 are spaced from each other. The first wick structure 42 is the same as the first wick structure 22 in the second embodiment.

At an evaporator section 411 of the heat pipe 40, the right sidewall 324 of the first wick structure 32, a left sidewall 423 of the first wick structure 42, and the inner surface of the second wick structure 44 cooperatively define a first passage 4411 therebetween. The left sidewall 123 of the first wick structure 12, a right sidewall 424 of the first wick structure 42, and the inner surface of the second wick structure 44 cooperatively define another first passage 4412 therebetween. The two first passages 4411, 4412 cooperatively form a first vapor channel 441.

At a condenser section 413 of the heat pipe 40, the right sidewall 324 of the first wick structure 32, the left sidewall 423 of the first wick structure 42, and the inner surface of the casing 11 cooperatively define a second passage 4421 therebetween. The left sidewall 123 of the first wick structure 12, the right sidewall 424 of the first wick structure 42, and the inner surface of the casing 11 cooperatively define another second passage 4422 therebetween. The two second passages 4421, 4422 cooperatively form a second vapor channel 442. Ends of the second passages 4421, 4422 communicate with ends of the first passages 4411, 4412, respectively.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flat heat pipe with an evaporator section and a condenser section at opposite ends thereof, the flat heat pipe comprising:

a hollow casing; and a first wick structure and a hollow second wick structure received in the casing, the first wick structure extending through both the evaporator section and the condenser section, and the second wick structure in contact with an inner surface of the casing at the evaporator section;

the first wick structure at the evaporator section comprising at least one first contact portion, a connecting portion, and at least one first isolated portion, the connecting portion extending through the second wick structure along a radial direction of the casing, the connecting portion directly contacting an annular, curved part of an inner surface of the casing surrounding the first wick structure, the at least one first contact portion in contact with an inner surface of the second wick structure, the at least one first isolated portion isolated from the inner surface of the second wick structure, and the at least one first isolated portion and the inner surface of the second wick structure cooperatively defining a first vapor channel therebetween;

the first wick structure at the condenser section comprising at least one second contact portion and at least one second isolated portion, the at least one second contact portion in contact with the inner surface of the casing, the at least one second isolated portion isolated from the inner surface of the casing, and the at least one second isolated portion and the inner surface of the casing cooperatively defining a second vapor channel therebetween; and the first and second vapor channels in communication with each other.

2. The flat heat pipe of claim 1, wherein the first wick structure comprises a hollow tube made of woven wires, the second wick structure is made of sintered metal powder, and the first and second wick structures are joined together by sintering.

3. The flat heat pipe of claim 2, wherein the first wick structure comprises a top wall, a bottom wall opposite to the top wall, and a first sidewall and a second sidewall interconnecting the top and bottom walls, the first wick structure is located in the center of the casing, the first vapor channel comprises two first passages respectively defined between the sidewalls of the first wick structure and the inner surface of the second wick structure, the second vapor channel comprises two second passages respectively defined between the sidewalls of the first wick structure and the inner surface of the casing, and ends of the second passages communicate with ends of the first passages, respectively.

4. The flat heat pipe of claim 3, wherein the at least one first contact portion comprises one first contact portion, the at least one first isolated portion comprises two first isolated portions, the at least one second contact portion comprises two second contact portions, and the at least one second isolated portion comprises two second isolated portions; at the evaporator section, the bottom wall of the first wick structure forms the first contact portion in contact with the inner surface of the second wick structure, and the first and second sidewalls of the first wick structure form the two first isolated portions isolated from the inner surface of the second wick structure, respectively; and at the condenser section, the top and bottom walls of the first wick structure form the two second contact portions in contact with the inner surface of the casing, respectively, and the first and second sidewalls of the first wick structure form the two second isolated portions isolated from the inner surface of the casing, respectively.

5. The flat heat pipe of claim 4, wherein the connecting portion is the top wall of the first wick structure at the evaporator section.

6. The flat heat pipe of claim 2, wherein the casing comprises opposite top and bottom plates, and two opposite side plates between the top and bottom plates, the first wick structure comprises a top wall, a bottom wall opposite to the top wall, and a first sidewall and a second sidewall interconnecting the top and bottom walls, the first wick structure is disposed at and in direct contact with one of the side plates of the casing, the first vapor channel is defined between the first sidewall of the first wick structure and the inner surface of the second wick structure, and the second vapor channel is defined between the first sidewall of the first wick structure and the inner surface of the casing.

7. The flat heat pipe of claim 6, wherein the at least one first contact portion comprises two first contact portions, the at least one first isolated portion comprises one first isolated portion, the at least one second contact portion comprises one second contact portion, and the at least one second isolated portion comprises one second isolated portion; at the evaporator section, at least the top wall of the first wick structure forms one of the first contact portions in contact with the inner surface of the second wick structure, at least the bottom wall of the first wick structure forms the other first contact portion in contact with the inner surface of the second wick structure, and the second sidewall of the first wick structure forms the first isolated portion isolated from the inner surface of the casing; and at the condenser section, the top wall, the bottom wall and the first sidewall of the first wick structure cooperatively form the second contact portion in contact with the inner surface of the casing, and the second sidewall of the first wick structure forms the second isolated portion isolated from the inner surface of the casing.

8. The flat heat pipe of claim 7, wherein the connecting portion is a center portion of the first sidewall of the first wick structure at the evaporator section.

9. The flat heat pipe of claim 2, further comprising another first wick structure, wherein the casing comprises opposite top and bottom plates, and two opposite side plates between the top and bottom plates, the two first wick structures are disposed at and in direct contact with the opposite side plates of the casing, respectively, each of the two first wick structures comprises a top wall, a bottom wall opposite to the top wall, and a first sidewall and a second sidewall interconnecting the top and bottom walls, the second sidewalls of the first wick structures facing each other, the first vapor channel is defined between the first sidewalls of the first wick structures and the inner surface of the second wick structure, and the second vapor channel is defined between the first sidewalls of the first wick structures and the inner surface of the casing.

10. The flat heat pipe of claim 9, wherein the at least one first contact portion comprises four first contact portions, the at least one first isolated portion comprises two first isolated portions, the at least one second contact portion comprises two second contact portions, and the at least one second isolated portion comprises two second isolated portions; at the evaporator section, at least the top walls of the two first wick structures together form two of the first contact portions in contact with the inner surface of the second wick structure, at least the bottom walls of the two first wick structures together form the other two first contact portions in contact with the inner surface of the second wick structure, and the second sidewalls of the first wick structures form the two first isolated portions isolated from the inner surface of the second wick structure, respectively; and at the condenser section, the top wall, the bottom wall and the first sidewall of each first wick structure cooperatively form one of the second contact portions in contact with the inner surface of the casing, and the second sidewall of each first wick structure forms one of the second isolated portions isolated from the inner surface of the casing.

11. The flat heat pipe of claim 10, wherein the connecting portion is a center portion of the first sidewall of each first wick structure at the evaporator section.

12. The flat heat pipe of claim 2, further comprising another two first wick structures, wherein the casing comprises opposite top and bottom plates, and two opposite side plates between the top and bottom plates, the three first wick structures are spaced from each other, two of the first wick structures are disposed at and in direct contact with opposite side plates of the casing, the other first wick structure is located in the center of the casing, and each of the first wick structures comprises a top wall, a bottom wall opposite to the top wall, and a first sidewall and a second sidewall interconnecting the top and bottom walls; the first vapor channel comprises two first passages, one of the first passages is defined between the second sidewall of the first wick structure at one of the side plates of the casing, the first sidewall of the first wick structure in the center of the casing and the inner surface of the second wick structure, and the other first passage is defined between the second sidewall of the first wick structure at the other side plate of the casing, the second sidewall of the first wick structure in the center of the casing and the inner surface of the second wick structure; the second vapor channel comprises two second passages, one of the second passages is defined between the second sidewall of the first wick structure at one of the side plates of the casing, the first sidewall of the first wick structure in the center of the casing and the inner surface of the casing, and the other second passage is defined between the second sidewall of the first wick structure at the other side plate of the casing, the second sidewall of the first wick structure in the center of the casing and the inner surface of the casing; and ends of the second passages communicate with ends of the first passages, respectively.

13. The flat heat pipe of claim 12, wherein the at least one first contact portion comprises five first contact portions, the at least one first isolated portion comprises four first isolated portions, the at least one second contact portion comprises four second contact portions, and the at least one second isolated portion comprises four second isolated portions; at the evaporator section, the bottom wall of the first wick structure in the center of the casing forms one of the first contact portions in contact with the inner surface of the second wick structure, at least the top wall of each of the other two first wick structures at the opposite side plates of the casing together form two of the first contact portions in contact with the inner surface of the second wick structure, at least the bottom wall of each of the other two first wick structures at the opposite side plates of the casing together form the other two of the first contact portions in contact with the inner surface of the second wick structure, the first and second sidewalls of the first wick structure in the center of the casing form two of the first isolated portions isolated from the inner surface of the second wick structure, respectively, and the second sidewalls of the other two first wick structures at the opposite side plates of the casing form the other two first isolated portions isolated from the inner surface of the second wick structure, respectively; and at the condenser section, the top and bottom walls of the first wick structure in the center of the casing form two of the second contact portions in contact with the inner surface of the casing, respectively, the top wall, the bottom wall and the first sidewall of each of the other two first wick structures at the opposite side plates of the casing cooperatively form another one of the second contact portions in contact with the inner surface of the casing, the first and second sidewalls of the first wick structure in the center of the casing form two of the second isolated portions isolated from the inner surface of the casing, and the second sidewall of each of the other two first wick structures at the opposite side plates of the casing forms another one of the second isolated portions isolated from the inner surface of the casing.

14. The flat heat pipe of claim 13, wherein at the evaporator section the first wick structure further comprises another two connecting portions in contact with the inner surface of the casing, the top wall of the first wick structure in the center of the casing forms the connecting portion, and center portions of the first sidewalls of the other two first wick structures at the opposite side plates of the casing form the another two connecting portions.

15. The flat heat pipe of claim 1, wherein the second wick structure contacts a portion of the inner surface of the casing at the evaporator section.

16. The flat heat pipe of claim 1, wherein the first wick structure has an extruded, flattened shape.

17. The flat heat pipe of claim 1, wherein a height of the casing is less than 2 millimeters.

18. A flat heat pipe with an evaporator section and a condenser section at opposite ends thereof, the flat heat pipe comprising:

a hollow flat casing; and a first wick structure and a hollow second wick structure received in the casing, the first wick structure extending through both the evaporator section and the condenser section, the second wick structure disposed at least mostly at the evaporator section and contacting an inner surface of the casing;

wherein at the evaporator section, the first wick structure comprises a first contact portion in contact with an inner surface of the second wick structure, a first isolated portion isolated from the inner surface of the second wick structure, and a connecting portion in contact with a part of the inner surface of the casing, the part of the inner surface of the casing is curved and annular and surrounds the first wick structure, the connecting portion extends through the second wick structure along a radial direction of the casing, and the first isolated portion and the inner surface of the second wick structure cooperatively define a first vapor channel therebetween;

wherein at the condenser section, the first wick structure comprises a second contact portion in contact with the inner surface of the casing, and a second isolated portion isolated from the inner surface of the casing, and the second isolated portion and the inner surface of the casing cooperatively define a second vapor channel therebetween; and wherein the first and second vapor channels communicate with each other.

19. The flat heat pipe of claim 18, wherein the first wick structure is a hollow tube made of woven wires, the second wick structure is made of sintered metal powder, and the first and second wick structures are joined together by sintering.

20. The flat heat pipe of claim 18, wherein the casing comprises opposite top and bottom plates, and two opposite side plates between the top and bottom plates, and the first wick structure is disposed at and in direct contact with one of the following locations: one of the side plates, and the center of the casing.

* * * * *